United States Patent [19]

Reed

[11] Patent Number: 4,969,976

[45] Date of Patent: Nov. 13, 1990

[54] PULP DEWATERING PROCESS

[75] Inventor: Robert Reed, West Yorkshire, England

[73] Assignee: Allied Colloids Ltd., Great Britain

[21] Appl. No.: 329,665

[22] Filed: Mar. 28, 1989

[30] Foreign Application Priority Data

Mar. 28, 1988 [GB] United Kingdom ..... 8807445

[51] Int. Cl.[5] ..... D21H 17/20; D21H 17/68

[52] U.S. Cl. ..... 162/164.3; 162/100; 162/164.6; 162/166; 162/168.2; 162/168.3; 162/175; 162/181.6; 162/181.8; 162/182; 162/183

[58] Field of Search ..... 162/175, 181.6, 181.8, 162/183, 168.2, 168.3, 100, 182, 164.6, 164.3, 166

[56] References Cited

U.S. PATENT DOCUMENTS 4,305,781 12/1981 Langley et al. ..... 162/181.8

4,753,710 6/1988 Langley et al. ..... 162/168.3

*Primary Examiner*—Peter Chin

*Attorney, Agent, or Firm*—Ostrolenk, Faber, Gerb & Soffen

[57] ABSTRACT

Dry market pulp is made by shearing a cellulosic suspension and draining it through a screen to form a pulp sheet which is then dried, and the productivity of the process is increased by adding a water soluble cationic polymer before the shearing and bentonite or other suitable inorganic material after the shearing.

12 Claims, No Drawings

PULP DEWATERING PROCESS

Paper or paper board is made by forming an aqueous cellulosic suspension (usually known as a thin stock), draining the suspension to form a sheet, and drying the sheet. The draining and drying stages are designed such that the sheet has the desired properties for the final paper or paper board and so generally involves calendering or other surface treatments to impart adequate smoothness and other performance properties to the sheet.

In order to optimise the process, it has for many years been standard practice to add various chemical additives to the suspension, and cationic polymers have been widely used for this purpose. Originally they were always natural or modified natural polymers, such as cationic starch, but synthetic cationic polymers have been widely used for many years. Their purpose is to act as retention aids and/or as dewatering aids and the polymer is chosen having regard to the desired property. A retention aid serves to retain fine fibres and fine filler particles in the sheet. A dewatering aid serves to increase the rate of drainage or to increase the rate of drying after drainage. These properties can be mutually conflicting and so a large amount of effort has, in recent years, been put into ways of optimising drainage and dewatering.

The need to improve the quality of the final paper, to avoid loss of fibre or filler fines (for instance for environmental pollution reasons) and to optimise dewatering means that substantially every significant paper making process has, for many years, been operated using one or more retention and/dewatering aids The research into ways for improving these properties has led to the use of different materials in the same process, including the use of sequential addition of different materials. One such process is described in U.S. Pat. No. 4,388,150 and has been commercialised under the trade name Composil (trade mark ), and involves the addition of cationic starch followed by colloidal silicic acid.

A particuarly successful process has been commercialised under the trade name Hydrocol (trade mark) and is described in EP No. 235893. It involves the addition of a synthetic cationic polymer, followed by shearing of the suspension, followed by the addition of bentonite. It is of particular value in the production of fine papers.

The aqueous cellulosic suspensions that are used as the starting material in all these processes, and to which various retention aids and/or dewatering aids are then added, are in all instances made by pulping a fibrous cellulosic material, generally wood. The pulping involves comminution and suspension of the resultant fibres in water, and it is generally necessary to wash and filter the pulp several times. The filtering is normally effected by drainage through a screen.

Some modern plants consist of integrated mills that serve both as pulp and paper mills, i.e., wood or other feedstock is converted to a pulp which is subjected to various washing and filtering stages and is finally diluted to a thin stock that is then drained to form the paper or paper board. In integrated mills of this type, it is unnecessary to dry the pulp at any stage, since it has to be resuspended in water at the same mill. Accordingly the main objective is to ensure that the drainage occurs quickly during each washing and filtering stage.

In practice adequate drainage occurs without the addition of any drainage aid and so normally no addition of cationic polymers is made at the pulp end of an integrated mill, although extensive and sophisticated additions of cationic polymers are made at the paper end of the mill.

The more traditional method of making paper and board (and which is still used on a large scale worldwide) involves separation of the pulp-making and paper-making facilities. Thus wood or other fibrous cellulosic material is converted in a pulp mill to a dry product generally known as "dry market pulp". This dry pulp is then used as the feedstock at a paper mill to make the aqueous cellulosic suspension that is drained to make the paper or paper board. For instance the dry pulp may first be dispersed in water to form a thick stock which is then diluted to form a thin stock.

The pulping stages in the pulp mill can be generally similar to the pulping stages in an integrated mill but at the end of the washing stages it is necessary to drain the pulp and then thermally dry it. This drainage is normally conducted on a machine known as a "lap pulp machine".

It has, of course, been known for many years that the drainage in this and the preceding stages could possibly be accelerated by the addition of a drainage aid but, despite the addition of sophisticated dewatering and retention systems in paper mills, it has not been found useful to add any such systems in pulp mills. One reason is that drainage aids may tend to reduce retention and since drainage is relatively fast in any event the disadvantage of reducing retention outweighs the advantage of accelerating drainage. Conversely, a retention aid is generally unnecessary since retention is satisfactory under normal drainage conditions. A further disadvantage of drainage aids is that they tend to increase the amount of thermal drying that is required. Thus they accelerate the free drainage but they result in the wet sheet containing a larger amount of trapped water, and so additional thermal drying is required.

The present state of the art therefore is that there is widespread use of cationic synthetic polymers (alone or with other materials) in the paper making stages but there is substantially no use of cationic polymers in the pulp making stages because the application to the pulp stages of the paper making chemical technology is not cost effective and may even worsen, rather than improve, the pulp making process.

Nevertheless it would, of course, be desirable to increase the rate of pulp production and, in particular, to increase the rate of production of dry market pulp and/or to reduce the amount of thermal energy that is required before drying it.

Despite the co-existence for many years of additive-free pulp making processes and of additive-including paper making processes, and despite all the contra-indications that warn against including additives in a pulp making process, we have now found that one particular set of additives do give a remarkable and beneficial improvement in the production of dry market pulp.

In a pulp making process according to the invention, fibrous cellulosic material is pulped to form an aqueous suspension of cellulosic material, the suspension is subjected to one or more shear stages, the sheared suspension is drained through a screen to form a pulp sheet and the pulp sheet is dried to form a dry market pulp, and a water soluble polymer is added to the suspension before the shear stage or before one of the shear stages and an inorganic material is added to the suspension after that shear stage. The polymer is one that promotes drainage of the suspension through the screen and is selected from cationic starch and substantially linear synthetic cationic polymers. The inorganic material is selected from colloidal silicic acid and bentonite.

The polymer can be cationic starch, as described in U.S. Pat. No. 4,388,150.

Preferably, however, the polymer is a substantially linear synthetic cationic polymer. It should have a molecular weight of above 500,000, preferably above about 1 million and often above about 5 million for instance in the range 10 to 30 million or more.

The polymer may be a polymer of one or more ethylenically unsaturated monomers, generally acrylic monomers, that consist of or include cationic monomer.

Suitable cationic monomers are dialkyl amino alkyl-(meth) acrylates or -(meth) acrylamides, either as acid salts or, preferably, quaternary ammonium salts. The alkyl groups may each contain one to four carbon atoms and the aminoalkyl groups may contain one to eight carbon atoms. Particularly preferred are dialkylaminoethyl (meth) acrylates, dialkylaminomethyl (meth) acrylamides and dialkyl amino-1,3-propyl (meth) acrylamides. These cationic monomers are preferably copolymerised with a non-ionic monomer, preferably acrylamide. Other suitable cationic polymers are polyethylene imines, polyamine epichlorohydrin polymers, other polyamines, polycyandiamide formaldehyde polymers and homopolymers or copolymers, generally with acrylamide, of monomers such as diallyl dimethyl ammonium chloride.

The preferred polymers have an intrinsic viscosity above 4 dl/g. Intrinsic viscosities herein are derived in standard manner from determination of solution viscosities by suspended level viscometer of solutions at 25° C. in 1 Molar NaCl buffered to pH about 7 using sodium phosphate.

The polymer should be linear relative to the globular structure of cationic starch. It can be wholly linear or it can be slightly cross linked, as described in EP No. 202780. For instance it can be a branched product such as the polyethylene imine that is sold under the trade name Polymin SK.

In general, the molecular weight and chemical type of the polymer should be selected such that the polymer will promote drainage of the suspension through the screen. In general this means that the polymer is one that would be suitable for use as a retention or drainage aid in the production of paper.

The cationic polymer preferably has a relatively high charge density, for instance above 0.2, preferably at least 0.35, most preferably 0.4 to 2.5 or more, equivalents of cationic nitrogen per kilogram of polymer.

The inorganic material may be colloidal silicic acid that may be modified silicic acid as described in No. W086/5826, or may be other inorganic particulate material such as bentonite. Preferably the inorganic material has an extremely small particle size and thus should be of pigment size and preferably it is swellable in water.

When the polymer is cationic starch, the use of colloidal silicic acid is often preferred. When the polymer is synthetic, the preferred materials are bentonites, that is to say bentonite-type clays such as the anionic swelling clays known as sepialites, attapulgites and, most preferably, montmorillinites. Suitable montmorillinites include Wyoming bentonite and Fullers Earth. The clays may or may not be chemically modified, e.g., by alkali treatment to convert calcium bentonite to alkali metal bentonite.

In general, the polymers and the bentonites should preferably be as described in EP No. 235893.

It is important to add the bentonite or other silicate or other inorganic material after shearing, and to add the polymer before shearing. The pulp making process includes one or more shear stages, for instance cleaning, mixing and pumping stages such as are typified by centriscreens, vortex cleaners, fan pumps and mixing pumps. The polymer must be added before one of these and the bentonite or other inorganic material at a later stage. Generally the bentonite is added after the last shear stage and the polymer at some earlier stage, for instance just before the last shear stage. Thus the polymer may be added as the aqueous pulp leaves the penultimate shear stage or approaches the final shear stage (for instance a centriscreen or fan pump) and the bentonite or other inorganic material may be added substantially at the head box for the drainage screen. Thus the bentonite may be added at the head box, or just prior to the head box, of the lap pulp machine, accompanied by sufficient mixing to mix the bentonite throughout the pulp, generally without applying significant shear at this stage.

This treatment prior to the lap pulp machine can have two beneficial effects. First, it can increase the rate of drainage. Second, and most important, the drained sheet can be easier to dry than when cationic polymer alone is used. As a result the pulp sheet can be passed through the driers more quickly (or a thicker sheet can be passed at the same rate) and thus it is possible to increase the production of the pulp mill and/or reduce the amount of thermal drying that is required, while producing a dry market pulp having suitable properties for normal paper making process. This pulp is in the form of crude, non-calendered, sheet typically having a fibre weight of 100 to 1000 g/m$^2$.

The amount of polymer that has to be added will depend upon the nature of the pulp. It will normally be at least 0.005% and usually is at least 0.01 or 0.02%. Although amounts above 0.1% are usually unnecessary, larger amounts can be used (typically 0.2%, 0.3% or even up to, for instance, 0.5%. Preferred amounts are in the range 0.02 to 0.1% (200 to 1000 grams polymer per ton dry weight pulp).

The amount of inorganic material will be selected according to the nature of the pulp and the amount and type of polymer and the type of inorganic material. Suitable amounts, especially when the inorganic material is bentonite, are generally above 0.03% and usually above 0.1%, but amounts above 0.5% are generally unnecessary. The preferred process uses from 1000 to 2500 kg bentonite per ton dry weight of pulp.

The aqueous pulp to which the polymer is added will have been made by conventional methods from the wood or other feedstock. Deinked waste may be used to provide some of it. For instance the wood may be debarked and then subjected to grinding, chemical or heat pulping techniques, for instance to make a mechanical pulp, a thermomechanical pulp or a chemical pulp. The pulp may have been washed and drained and rewashed with water or other aqueous wash liquor prior to reaching the final drainage stage on the lap pulp machine. The dry market pulp is generally free or substantially free of filler, but filler can be included if desired.

After drainage through the screen of the lap pulp machine, the resultant wet sheet is then subjected to drying in conventional manner, for instance through a tunnel drier or over drying cylinders, or both.

By the invention it is possible easily to increase the production rate of dry market pulp, of constant water content, by 10 to 20% or even up to 30% or more.

The following are some examples.

EXAMPLE 1

A pulp mill is operated in conventional manner to produce chemi-thermo mechanical pulp by conventional techniques terminating in pumping the pulp through a pump to the head box of a lap pulp machine, the pulp then being drained through the screen of this machine and taken off the screen and thermally dried to form the dry market pulp. When no polymeric or bentonite additives are included and the head box consistency is 1.42%, the mill operates at a speed of 81.1 meters per minute to produce 7.3 tonnes per hour of dried sheet weighing 566 g/m$^2$ and having a dryness after the third press of 43.8%. The steam demand is 6.6 tonnes per hour.

In a process according to the invention, 700 grams per ton of a copolymer of 70% by weight acrylamide 30% by weight dimethylaminoethyl acrylate methyl chloride quaternary salt, intrinsic viscosity 10 dl/g, is added just before the pump and 2 kg/ton bentonite is added at the head box. The consistency in the head box is 1.36%. The machine runs at a speed of 83.7 meters per minute and produces 9.1 tonnes per hour of dry market pulp at 677 g/m$^2$ and having a dryness after the third press of 46%. The steam demand is 9.5 tonnes per hour. Thus the process of the invention gives an improvement in production of about 25% whilst reducing steam demand (per ton of pulp) and increasing dryness.

When the process is repeated using half the amount of polymer, the increased production is less, but is still more than 10% above the process in the absence of polymer and bentonite.

EXAMPLE 2

To demonstrate the effect of varying the proportions of polymer and bentonite, a pulp of tissue fibres having a freeness value of 450 has a specified amount of polymer added to it, the mixture is subjected to high shear mixing for about one minute, bentonite is added and a standard volume of the pulp is subjected to a standard drainage evluation on a drainage tube using a standard machine wire. The time is recorded in seconds. The value should be low.

The process is conducted using pulp A, which is a peroxide bleached chemi-thermo mechanical pulp and pulp B, which is a bleached sulphite pulp. The process is conducted with polymer C which is a copolymer having intrinsic viscosity from 8 to 10 dl/g of 70% by weight acrylamide and 30% by weight dimethylaminoethyl acrylate quaternised with methyl chloride, and with polymer D which is formed from the same monomers in a weight ratio 76:24 and has intrinsic viscosity 6 to 8.

The results are shown in the following table in which the amount of polymer and bentonite that is added is given in kg/ton dry weight of pulp and the dewatering time is measured in seconds.

| Pulp | Polymer | Bentonite | Dewatering Time |
|---|---|---|---|
| A | 0 | 0 | 94 |
| A | 1C | 2 | 45 |
| A | 1.5C | 2 | 24 |
| A | 2C | 2 | 18 |
| A | 3C | 2 | 16 |
| A | 2C | 0 | 45 |
| A | 2C | 1 | 20 |
| A | 2C | 1.5 | 16 |
| A | 2C | 2.5 | 18 |
| B | 0 | 0 | 29 |
| B | 0.3D | 2 | 20 |
| B | 0.8D | 2 | 14 |
| B | 1.2D | 2 | 14 |
| B | 1.6D | 2 | 14 |
| B | 0.5D | 0.5 | 20 |
| B | 0.5D | 1 | 18 |
| B | 0.5D | 1.5 | 16 |
| B | 0.5D | 2.5 | 17 |

The benefit of the sequential addition of polymer and bentonite, relative to a process in which no addition is made or polymer only is made, is clearly apparent from this table.

I claim:

1. In a pulp making process for making dry market pulp that can subsequently be reslurried in water to form a paper-making suspension, wherein fibrous cellulosic material is pulped to form an aqueous suspension of cellulosic material, the suspension is subjected to one or more shear stages, the sheared suspension is drained through a screen to form a pulp sheet and the pulp sheet is dried to form the dry market pulp, the improvement comprising adding a water soluble polymer to the suspension before the shear stage or before one of the shear stages and adding an inorganic material to the suspension after such shear stage, said water soluble polymer promoting drainage of the suspension through the screen and being selected from the group consisting of cationic starch and substantially linear cationic polymers, and said inorganic material being selected from the group consisting of colloidal silica and bentonite, and wherein said water soluble polymer is added in an amount of 0.01 to 0.5% and said inorganic material is added in an amount of from 0.03 to 0.5% based on the dry weight of the suspension.

2. A process according to claim 1 in which said polymer is a cationic substantially linear synthetic polymer having a molecular weight of above 500,000 and a charge density above 0.2 equivalents of cationic nitrogen per kilogram of polymer.

3. A process according to claim 2 in which the polymer is selected from polyethylene imine, polyamine epichlorhydrin products, polyamines, polydicyandiamide formaldehyde polymers, polymers of diallyl dimethyl ammonium chloride and polymers of acrylic monomers comprising a cationic acrylic monomer.

4. A process according to claim 2 in which the polymer is a cationic polymer having intrinsic viscosity above 4 dl/g and formed from acrylic monomers comprising dialkylaminoalkyl (meth) -acrylate or -acrylamide, as acid or quaternary salt.

5. A process according to claim 2 in which the inorganic material is bentonite.

6. A process according to claim 2 in which the one or more shear stages are selected from cleaning, mixing and pumping stages comprising a centriscreen, a vortex cleaner, a fan pump or a mixing pump.

7. A process according to claim 1 in which the inorganic material is added to the suspension substantially immediately before the drainage through the screen.

8. A process according to claim 1 in which the polymer is added to the suspension and is subjected to shearing, the sheared suspension is fed to the head box of a lap pulp machine having a drainage screen, the inorganic material is added substantially at the head box, and the suspension is drained through the said screen to form the pulp sheet.

9. A process according to claim 1 wherein said fibrous cellulosic material comprises wood.

10. A process according to claim 1 wherein said screen is the screen of a lap pulp machine.

11. A pulp-making process in which fibrous cellulosic material is pulped to form an aqueous suspension of cellulosic material, the suspension is subjected to one or more shear stages, selected from cleaning, mixing and pumping stages comprising a centriscreen, a vortex cleaner, a fan pump or a mixing pump and the sheared suspension is fed to the head box of a lap pulp machine having a drainage screen, and the suspension is drained through the screen to form a pulp sheet and the sheet is dried to form dry market pulp, and in which 0.01 to 0.5% (dry weight) of a water soluble cationic polymer is added to the suspension before the final shear stage, said polymer being selected from polyethylene imine, polyamine epichlorhydrin products, polyamines, polydicyandiamide formaldehyde polymers, polymers of diallyl dimethyl ammonium chloride and polymers of acrylic monomers comprising a cationic acrylic monomer, and 0.03 to 0.5% (dry weight) of bentonite is added to the suspension substantially at the said head box.

12. A process according to claim 11 wherein said fibrous cellulosic material comprises wood.

* * * * *